United States Patent [19]

Wyland et al.

[11] 4,319,989

[45] Mar. 16, 1982

[54] MAGNETIC SEPARATOR

[75] Inventors: Donald J. Wyland, Brighton; Michael W. Stowe, Pontiac, both of Mich.

[73] Assignee: Industrial Magnetics, Inc., Troy, Mich.

[21] Appl. No.: 200,462

[22] Filed: Oct. 24, 1980

[51] Int. Cl.[3] ..... B03C 1/02

[52] U.S. Cl. ..... 209/225; 137/544

[58] Field of Search ..... 209/216, 223 R, 223 A, 209/224, 225, 228, 231; 137/544

[56] References Cited

U.S. PATENT DOCUMENTS

| | | | |
|---|---|---|---|
| 466,514 | 1/1892 | Reed | 209/223 R |
| 971,692 | 10/1910 | Schnelle | 209/223 R |
| 2,163,242 | 6/1939 | Kagan | 209/223 R |
| 2,622,937 | 12/1952 | Taylor | 55/100 X |
| 2,699,871 | 1/1955 | Stem | 209/223 R |
| 2,781,128 | 2/1957 | Stem | 209/223 R |
| 2,992,735 | 7/1961 | Troy | 209/223 R |
| 3,006,472 | 10/1961 | Clute | 209/223 R |
| 3,351,195 | 11/1967 | Hukki | 209/211 |
| 3,498,455 | 3/1970 | Kirby | 209/223 R |
| 3,524,549 | 8/1970 | Walter | 209/228 X |
| 4,176,065 | 11/1979 | Cook | 209/223 R |

*Primary Examiner*—William A. Cuchlinski, Jr.
*Attorney, Agent, or Firm*—Barnes, Kisselle, Raisch & Choate

[57] ABSTRACT

A magnetic separator in the form of a cylindrical duct of circular cross section having opposite end sections and a radially enlarged central section. Within the central section is arranged an axially extending cylindrical magnet assembly. The diameter of the central section is determined in relation to the diameter of the magnet assembly so that the flow rate throughout the duct is generally constant.

3 Claims, 5 Drawing Figures

MAGNETIC SEPARATOR

This invention relates to a magnetic separator for a pneumatic conveying system.

A large variety of products, such as grain and other small granular powdered products, are handled in bulk by means of pneumatic conveying systems, such as when loading and unloading trucks, rail cars, ships, and the like. It is not uncommon in such pneumatic systems to provide some form of magnetic separator for removing tramp metal from the product being conveyed. Such magnetic separators as heretofore proposed have several serious drawbacks. In many instances they are costly, inefficient and not adapted for high pressure conveying systems. In some systems the construction, design and arrangement of the magnetic separator results in a substantial pressure drop and a reduction in air velocity in the system.

The present invention has for its primary object the provision of a magnetic separator for a pneumatic conveying system that is of economical construction, highly efficient in operation, admirably suited for high pressure systems and which does not appreciably reduce the air pressure or velocity in any section of the pneumatic system.

More specifically, the present invention contemplates a cylindrical duct of preferably circular cross section which is adapted to be connected in series with the air-product conduit of the pneumatic conveyor system. The cylindrical duct has a section intermediate its ends in which an elongated permanent magnet assembly is coaxially supported. The duct and the magnet assembly are dimensioned and shaped so as to remove tramp metal from the product with a negligible line pressure drop and to maintain a substantially constant flow rate throughout the system.

Other objects, features and advantages of the present invention will become apparent from the following description and accompanying drawings, in which.

Figure 3:
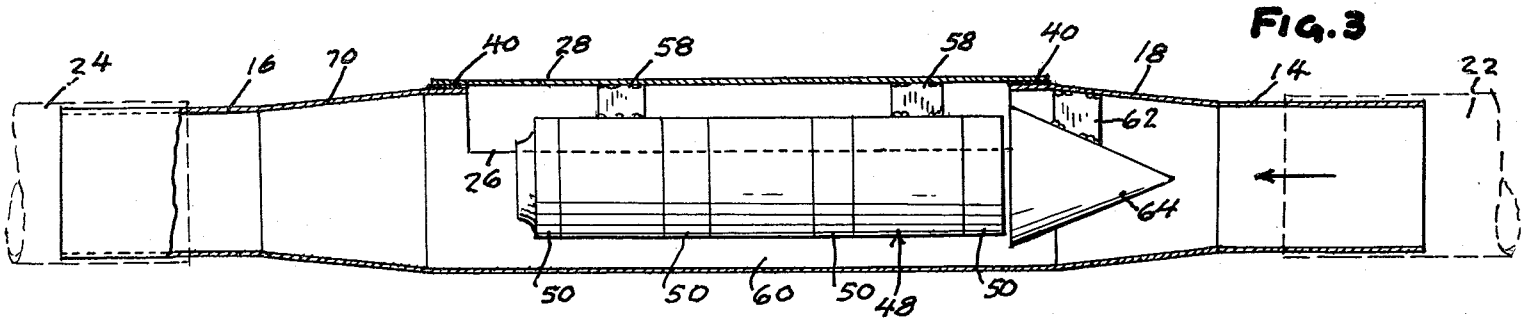
FIG. 3 is an axial sectional view of the separator.
Figure 4:
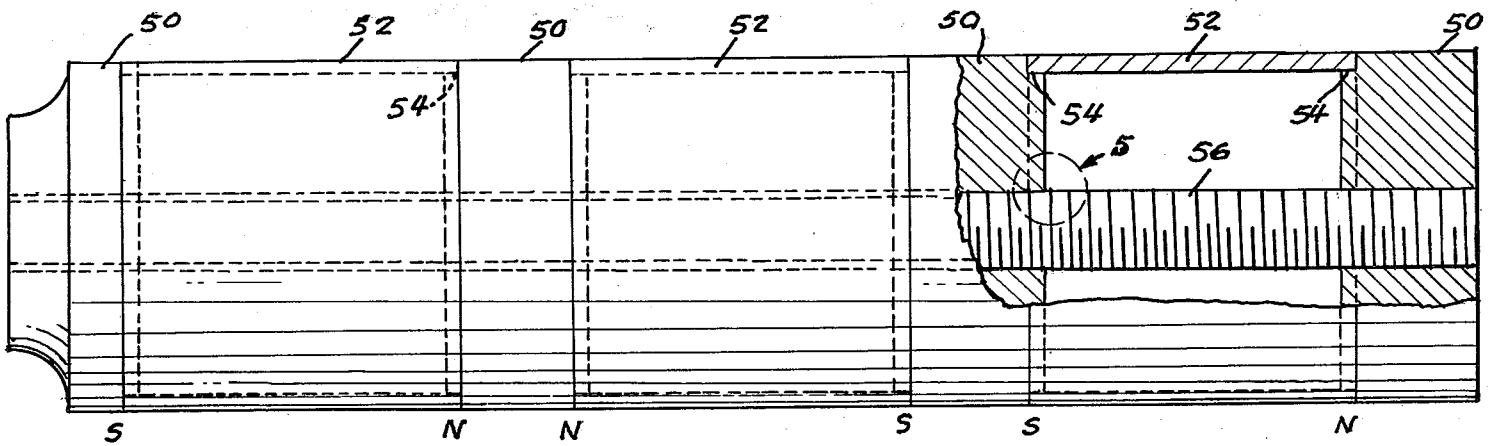
FIG. 4 is an enlarged view of the magnet assembly partly in section.
Figure 5:
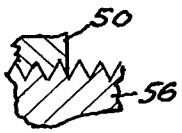
FIG. 5 is a fragmentary sectional view of a portion of the magnet assembly shown in FIG. 4 which is designated by the circle 5.

The magnetic separator of the present invention comprises a housing 10 in the form of a duct of circular cross section having a cylindrical center section 12, a pair of cylindrical end sections 14,16 of smaller diameter than the central section 12, and a pair of fructoconical sections 18,20 interconnecting the two end sections with the opposite ends of the central section. As shown in FIG. 3, the two end sections 14,16 are adapted to be connected in any suitable fashion with conduits 22,24 of a pneumatic conveyor system so that the duct 10 forms a part of and is in series relation with the conveyor duct. Suitable means (not shown) are provided for directing a high velocity air stream through the conveyor conduit in the direction of the arrow 25. Thus, section 14 is at the upstream end of duct 10 and section 16 is at the downstream end of duct 10. The magnetic separator of the present invention is designed to be used in pneumatic conveyor systems wherein the pressure or vacuum is at least one atmosphere (14.7 lbs./sq.in.) and where the product is adapted to travel through the system at a velocity as high as 4,000 feet per minute. The circular construction of duct 10 is admirably suited for such applications.

Figure 1:
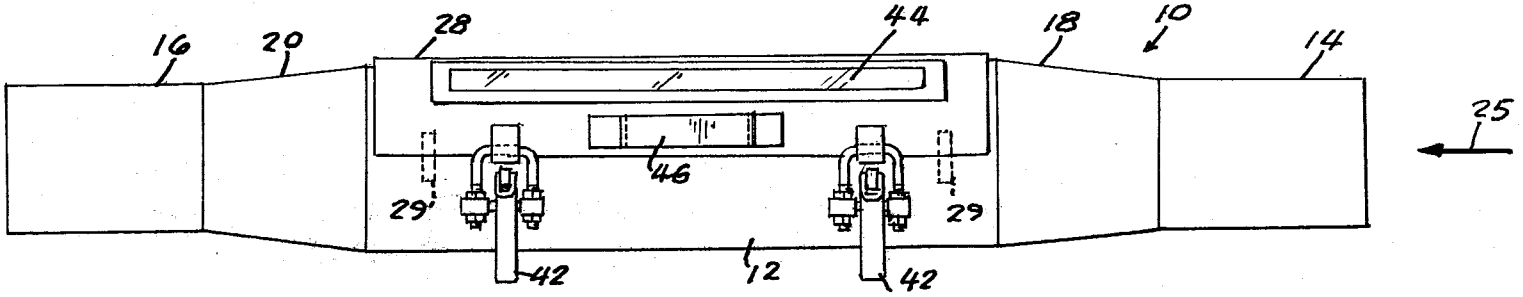
FIG. 1 is a side elevational view of the magnetic separator according to the present invention.
Figure 2:
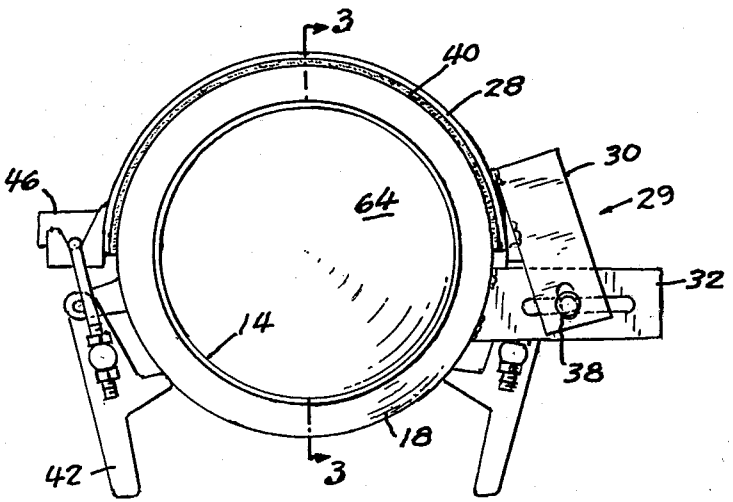
FIG. 2 is an end view of the separator shown in FIG. 1.

The central section 12 is formed with an access opening 26 of generally rectangular shape. Opening 26 extends around the periphery of section 12 for an arcuate extent of preferably about 140°. During operation of the system opening 26 is closed by an arcuate cover 28 which, if desired, may be hinged to the section 12 as at 29. As shown in FIG. 2, each hinge comprises a bracket 30 welded to cover 28 and a bracket 32 welded to section 12. Brackets 30,32 are formed with elongated openings 34,36, respectively, through which a pin 38 extends. This hinged construction enables cover 28 to seat firmly on and seal with a gasket 40 which extends around the periphery of opening 26. An air tight connection between cover 28 and section 12 can be obtained by employing two pairs of toggle clamps 42 adjacent each end of cover 28. Cover 28 is optionally provided with a transparent window 44 for viewing the interior of the duct and with a handle 46 to facilitate opening and closing of the cover.

Within the central section 12 of duct 10 there is arranged a permanent magnet assembly 48. Magnet assembly 48 comprises a series of annular permanent magnets 50 which are spaced apart axially. Between these magnets are arranged non-magnetic stainless steel spacer sleeves 52. The magnets 50 are magnetized so that the adjacent faces of adjacent magnets are of opposite polarity. Sleeves 52 are stainless steel tubes which, at their opposite ends, are seated on annular shoulders 54 formed on the magnets. Sleeves 52 preferably have an axial dimension substantially greater than the axial dimension of magnets 50. The magnets and spacers are held in axially assembled relation by a non-magnetic rod 56 which is threaded through the center of each of the magnets. Magnet assembly 48 is fixedly mounted on cover 28 by a pair of brackets. Brackets 58 are located and dimensioned such that, when cover 28 closes the opening 26, magnet assembly 48 is located within section 12 concentrically thereof and cooperates therewith to form an annular passageway 60 through section 12. The cross section of magnet assembly 48 is related in size to the cross section of section 12 so that the cross sectional area of annular passageway 60 is generally the same as the cross sectional area of the end section 14,16 so as to maintain a substantially constant flow rate throughout the duct 10. Within the upstream conical section 18 there is supported, as by a bracket 62, a conical nose member 64 formed of a non-magnetic material such as stainless steel. The base of conical member 64 is spaced closely adjacent the upstream end of magnet assembly 48 and has a diameter slightly larger than the diameter of magnet assembly 48. Conical member 64 assists in maintaining the air flow velocity at a substantially constant value with a negligible line pressure drop. In order to achieve the highest efficiency of magnet assembly 48 the entire duct 10, cover 28, the supporting brackets, hinges and handle are formed of a non-magnetic material such as stainless steel. The highly concentrated magnetic field produced by magnets 58 is thus concentrated around the outer periphery of the magnet assembly 48.

In a pneumatic conveyor system the magnetic separator of the present invention can be located in any convenience location, such as the receiving station of the system or even adjacent the discharge end thereof. In any event, the product being conveyed by the system is directed by the high velocity air stream through the duct 10 in a downstream direction. As a consequence, tramp metal being conveyed in the air stream with the product will deposit upon and become adherred to the outer surface of the magnet assembly 48. The tramp metal particles will, of course, be concentrated primarily around the poles of the magnets 50. However, a small amount may adhere to the spacers 52 because of the magnetic field extending between the successive magnets.

The straight through flow path design of duct 10 and magnet assembly 48 allows the tramp metal to become deposited upon the magnet assembly 48 with negligible line pressure loss. The aerodynamic design of magnet assembly 48 in conjunction with the conical member 64 in relation to the cross sectional areas of the various sections maintains a relatively constant rate of flow of air through the entire duct. The slightly larger base diameter of cone 64 in relation to the diameter of assembly 48 coupled with the intense magnetic field produced by magnets 50 reduces the possibility of the metallic particles which become adherred to the magnet assembly 48 from being washed off by the high velocity air stream flowing through the annular passageway 60.

The extent of tramp metal adherring to the magnet assembly 48 can be readily determined visibly through window 44. When the extent of accumulation is such that removal is desirable, the conveyor system is shut down momentarily, the toggle clamps 42 are loosened and cover 28 is pivoted outwardly so that the magnet assembly 48 is displaced entirely out of the duct 10. The accumulated metal is then easily wiped from the surface of the magnet assembly 48 and cover 28 is then returned to the closed sealed position. Thus, the present arrangement permits the conveyor system to be shut down for a minimum period of time to enable periodic removal of the tramp metal particles accumulating on the magnet assembly. If it is essential to operate the conveyor system continuously, a similar housing may be arranged as a bypass with the housing shown. With such an arrangement the magnet assembly in one housing will be operative while the other is being cleaned or otherwise serviced.

We claim:

1. A magnetic separator assembly for a pneumatic conveyor of the type comprising a cylindrical conduit through which granular material is adapted to be conveyed in one direction while suspended in a high velocity air stream directed through the conduit, said separator assembly comprising a cylindrical duct having an inlet section at one end, an outlet section at its opposite end and an intermediate section extending axially between and connected at its opposite ends to said inlet and outlet sections, said inlet section being frusto-conically shaped with its upstream end corresponding in shape and size with said conduit for connection therewith, said inlet section being of progressively increasing cross section in a downstream direction, said intermediate section being concentric with the axis of said inlet section and having a uniform cylindrical cross section corresponding in size and shape with the downstream end of the inlet section, an axially extending cylindrical magnet assembly within said intermediate section concentric with the axis thereof, the outer peripheral surface of said magnet assembly being relatively smooth in an axial direction, said outer peripheral surface cooperating with the surrounding inner surface of the intermediate section to define an annular, axially extending passageway around the magnet assembly for the flow of air-suspended granular material in a downstream direction therethrough and to which surface magnetic particles in said air stream are adapted to magnetically adhere, said annular passageway having a uniform cross sectional area which is generally of the same size as the upstream end of said inlet section, said intermediate section having an opening therein which registers axially with said magnet assembly and through which said magnet assembly is adapted to be removed, a removable cover sealingly closing said opening, said magnet assembly being supported within said intermediate section on said cover, said inlet section having a conically shaped member supported concentrically therein and being of progressively increasing cross section in a downstream direction, the outer surface of said conical member being spaced radially inwardly from the inner surface of said inlet section to define an annular passageway therebetween extending axially through said inlet section to the upstream end of said intermediate section, the downstream end of said conical member being located directly adjacent the upstream end of said magnet assembly.

2. A magnetic separator assembly as called for in claim 1 wherein said conical member is fixedly supported within said inlet section.

3. A magnetic separator assembly as called for in claim 2 wherein the downstream end of said conical member extends radially outwardly slightly beyond the outer peripheral surface of said magnet assembly.

* * * * *